US011380152B2

(12) United States Patent
Kanteti

(10) Patent No.: US 11,380,152 B2
(45) Date of Patent: Jul. 5, 2022

(54) METHOD AND SYSTEM FOR CHANGING THE PREMISES

(71) Applicant: Carrier Corporation, Palm Beach Gardens, FL (US)

(72) Inventor: Neeraja Kanteti, Telangana (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/251,477

(22) PCT Filed: Jun. 30, 2020

(86) PCT No.: PCT/IB2020/056180
§ 371 (c)(1),
(2) Date: Dec. 11, 2020

(87) PCT Pub. No.: WO2021/009599
PCT Pub. Date: Jan. 21, 2021

(65) Prior Publication Data

US 2021/0295628 A1 Sep. 23, 2021

(30) Foreign Application Priority Data

Jul. 12, 2019 (IN) ..... 201911028098

(51) Int. Cl.
*G07C 9/27* (2020.01)
*G07C 9/00* (2020.01)

(52) U.S. Cl.
CPC ..... *G07C 9/27* (2020.01); *G07C 9/00309* (2013.01); *G07C 9/00571* (2013.01); *G07C 9/00857* (2013.01); *G07C 9/00904* (2013.01); *G07C 2009/0088* (2013.01); *G07C 2009/00396* (2013.01)

(58) Field of Classification Search
CPC .. G07C 9/27; G07C 9/00571; G07C 9/00309; G07C 9/00904; G07C 2009/0088; G07C 2009/00396
USPC ..... 340/5.61
See application file for complete search history.

(56) References Cited

U.S. PATENT DOCUMENTS

2014/0120905 A1* 5/2014 Kim ..... H04W 12/068 455/426.1
2015/0221152 A1* 8/2015 Andersen ..... G07C 9/27 340/5.22

FOREIGN PATENT DOCUMENTS

EP 2355050 A2 8/2011

OTHER PUBLICATIONS

International Search Report for International Application No. PCT/IB2020/056180; International Filing Date: Jun. 30, 2020; dated Oct. 12, 2020; 3 pages.

(Continued)

*Primary Examiner* — Vernal U Brown
(74) *Attorney, Agent, or Firm* — Cantor Colburn LLP

(57) ABSTRACT

Systems and methods for changing the premises in a building such as a hotel or the like. An accessing device is encoded and provided to a guest to access first premises. The guest may request for second premises. Accordingly, the guest may receive information related to second premises along with a unique code to access the second premises. On entering the unique code the guest is prompting to receive second encoding associated with the second premises.

19 Claims, 4 Drawing Sheets

(56) References Cited

OTHER PUBLICATIONS

Written Opinion for International Application No. PCT/IB2020/056180; International Filing Date: Jun. 30, 2020; dated Oct. 12, 2020; 9 pages.

* cited by examiner

METHOD AND SYSTEM FOR CHANGING THE PREMISES

CROSS REFERENCE TO RELATED APPLICATIONS

This application is a National Stage application of PCT/IB2020/056180, filed Jun. 30, 2020, which claims the benefit of IN Application No. 201911028098, filed Jul. 12, 2019, both of which are incorporated by reference in their entirety herein.

TECHNICAL FIELD OF INVENTION

The present invention relates generally to access control systems. More particularly, the invention relates to an apparatus and method for changing premises in convenient way by using the access control systems.

BACKGROUND OF THE INVENTION

In existing access systems before accessing any premises, a guest receives an access card for accessing the room from an authorized person associated with the premises such as an attendant at the reception desk or can be a manager of an area including the premises. The card is encoded with the details for accessing the premises allocated to the guest. As an example, the premises can be a hotel room. Once the guest enters the room and finds that the room is not suitable for one or more reasons, the guest needs to ask for a room change. For this, the guest needs to walk all the way down to the reception desk. At the reception desk, there can be waiting time involved where the reception attendant may be busy in catering to other requests. On getting the turn, the guest requests for a room change at the reception desk. The attendant can allocate a different room by encoding a separate access card for a different room.

This consumes a lot of time of the guest as well the attendant. Moreover, the process is manually intensive for the guest. Further, the waiting time can be agonizing for the guests. The activity of changing a room is frequent in hotels.

Therefore, there is a need in the art to develop methods and systems for providing a solution to reduce the waiting time and also reducing the manual task involved for a guest while changing the room or premises.

SUMMARY OF THE INVENTION

Various embodiments of the invention describe a method for accessing the premises and also seamlessly changing the premises. The invention describes receiving a device encoded with a first encoding by a centralized system for permitting entry inside first premises. The device accesses the first premises by establishing a connection between the encoded device with the first encoding and a first accessing terminal associated with the first premises. The method describes requesting an access to second premises by communicating with a user of the centralized system. The user of the centralized system inputs the request to generate a unique code for the second premises. The unique code is received from the user of the centralized system for accessing the second premises. The invention further describes accessing the second premises with the unique code. The device is encoded with a second encoding by a second accessing terminal associated with the second premises after validation of the unique code.

In an embodiment of the invention, the first encoding and the second encoding comprise configuring details related to accessing the first premises or the second premises.

In another embodiment of the invention, the communication of the device with the first accessing terminal comprises validating the encoding by the centralized system.

In yet another embodiment of the invention, the second accessing terminal prompts for encoding the device after validating the unique code.

In still another embodiment of the invention, the centralized system communicates the unique code to a user terminal.

In another embodiment of the invention, accessing the second premises with the unique code and encoding the device with the second encoding by the second accessing device is done by a master user associated with the centralized system.

In another embodiment of the invention, the unique code is a numeric key generated by the centralized system.

In yet another embodiment of the invention, the unique code is a predefined pattern generated by the centralized system.

In another embodiment of the invention, the unique code is configured to be used only once.

In another embodiment of the invention an accessing device is disclosed. The accessing device comprises a first receiving unit for receiving a first encoding from a centralized system for permitting entry inside first premises. The accessing device further comprises an accessing unit configured to access the first premises by communicating the first encoding with a first access terminal associated with the first premises. The receiving unit further receives a second encoding from a second access terminal associated with a second premises. The second encoding is received based on a request to change the premises. The request is sent to a user of the centralized system. The user of the centralized system inputs the request to generate a unique code for accessing the second premises. The unique code is received by a user of the accessing device. The unique code is used by the user of the accessing device to access the second premises. Subsequently, the second encoding is received by the accessing device after validation of the unique code.

In another embodiment of the invention, the first encoding and the second encoding comprise configuring details related to accessing the first premises and the second premises, respectively.

In yet another embodiment of the invention, the second accessing device prompts for encoding the device after validating the unique code.

In still another embodiment of the invention, the second encoding is received from the centralized system by the second access terminal and transmitted to the receiving unit of the accessing device.

In another embodiment of the invention, accessing the second premises with the unique code and encoding the device with the second access terminal is done by a master user associated with the centralized system.

In another embodiment of the invention, the unique code is a numeric key generated by the centralized system.

In still another embodiment of the invention, the unique code is configured to be used only once.

In various other embodiments of the invention a computer readable medium is disclosed comprising one or more processors and a memory coupled to the one or more processors. The memory stores instructions which are executed by the one or more processors to receive a first encoding on an accessing device from a centralized system for permitting entry inside first premises. The or more processors are configured to access the first premises by connection between the accessing device encoded with the first encoding and a first access terminal associated with the first premises and receive a second encoding from a second access terminal associated with the second premises on the accessing device. The second encoding is received based on a request to change the premises. The request is sent to a user of the centralized system. The user of the centralized system inputs the request to generate a unique code for accessing the second premises. The unique code is received by a user of the accessing device and used to access the second premises. The second encoding is received after validation of the unique code.

In further embodiment of the invention, the encoding comprises configuring details related to accessing the first premises or the second premises.

In another embodiment of the invention, the unique code is a predefined pattern generated by the centralized system.

Various embodiments of the invention describe a user terminal comprising a first receiving module for receiving a first encoding by a centralized system for permitting entry inside first premises. The user terminal includes an accessing module for accessing the first premises by establishing a connection between the user terminal with the first encoding and a first access terminal associated with the first premises. A requesting module of the user terminal is used for requesting an access to second premises by communicating with the centralized system. The centralized system receives the request and generates a unique code for the second premises. The user terminal has a second receiving module for receiving the unique code from the centralized system to access the second premises. The user terminal accesses the second premises with the unique code and subsequently the first receiving module is configured to receive a second encoding from a second access terminal associated with the second premises.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

Corresponding reference numerals indicate corresponding parts throughout the drawings.

DETAILED DESCRIPTION OF THE INVENTION

Figure 1:
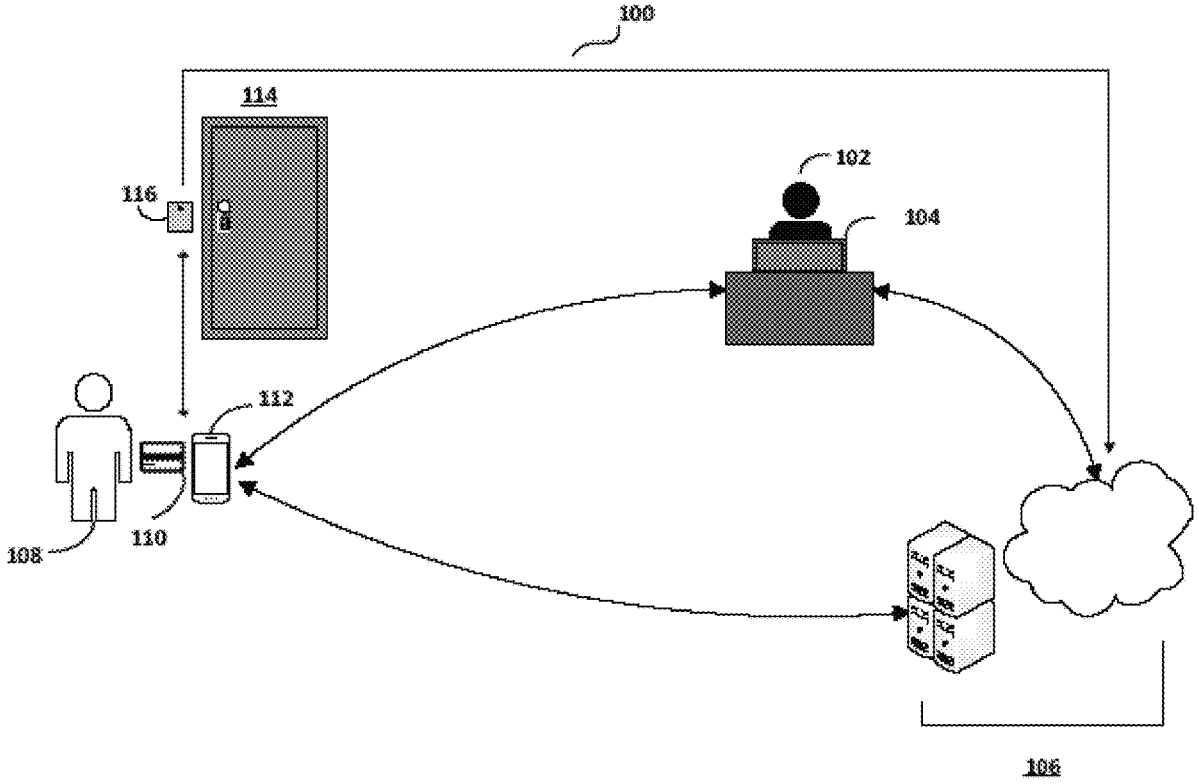
FIG. 1 is an exemplary block diagram illustrating different components of a system according to an exemplary embodiment of the invention.

Described herein is the technology with systems, methods, and devices for providing seamless mechanism for changing premises such as a hotel room and the like. The technology provides reducing the waiting time for a guest while changing a room by providing instant access to different premises based on a request from a guest.

Various embodiments of the invention describe a method of changing premises in a building, hotel and the like. The method describes receiving a device encoded with first encoding by an administrator (for example, attendant at the reception of a hotel) for gaining entry inside first premises. The first premises can be a hotel room for example, room number 101. The first encoding on the device represents all the details related to access and privileges provided to a guest using the device encoded with the first encoding. For example, the first encoding may include guest credentials along with unique codes/identifiers for accessing various premises of a hotel like room, gymnasium, bar, lounge etc. The guest can access the first premises by making the device interact with a first access terminal associated with the first premises (for example, room 101). The guest gains access inside the premises based on validation of the first encoding and/or guest credentials associated with the first encoding. The first access terminal is in communication with the centralized system. The first access terminal may establish communication with the centralized system for validating the first encoding for providing access to the guest.

After gaining access to the first premises, if the guest is not satisfied with the first premises, the guest may make a call to the reception desk and request the attendant at the reception desk for changing the premises. The attendant may take up the request based on availability of other premises. It may be noted that the guest may use other communication means such as messaging, or requesting on a user application associated with the centralized system. The attendant may input the request on a terminal associated with the centralized system to find out a second premises along with a unique code. The centralized system may output the second premises (for example, room 102) along with a unique code. The unique code may a numeric key or an alphanumeric key for example of 6 digits. The unique code may be communicated to the guest by the attendant or may be communicated on a user terminal associated with the guest.

In an embodiment of the invention, unique code may be a predefined pattern or a randomly generated pattern, for example turning the handle of a door associated with second premises "n" number of times along with entering the numeric or alphanumeric key. In another embodiment of the invention, the unique code may be presenting the existing device (with first encoding) "m" number of times and turning the handle of the door associated with the second premises "x" number of times. Various other patterns known to a person skilled in the art are within the scope of the invention.

The second premises (for example, room number 102) along with the unique code are communicated to the guest. The guest may go to the second premises and input the unique code on a second access terminal associated with the second premises to access the second premises. If the unique code is successful, the access terminal may prompt the guest to encode the device with a second encoding. The second access terminal may include a user interface to input the unique code. The second access terminal may include an interface to place the device for the second encoding. As discussed above, the second encoding may be similar to first encoding and may include the guest credentials and privileges to access the various locations associated with the second premises. The second encoding may take place on the same device on which first encoding was done. The second encoding may also take place without placing the device on the interface. The second access terminal and the device may communicate directly using a short range communication for encoding the device with second encoding. As an example, the short range communication may be a Bluetooth communication or a Wi-Fi communication. Various other communication means known in the art are also within the scope of the invention.

In an embodiment of the invention, there may be a master user associated with the centralized system to execute the task to input the unique code and encode the device with the second encoding. This can ensure more security of the system. The master user may encode the device with first encoding or may provide another card encoded with second encoding to the guest.

In an embodiment of the invention an accessing device is disclosed. The accessing device may be a Radio Frequency Identification (RFID) card or a Bluetooth enabled card for accessing the premises. The accessing device includes a receiving unit to receive a first encoding from a centralized system. The device may be encoded by an attendant associated with the centralized system. The first encoding enables a guest using the accessing device to gain entry inside first premises. The accessing device includes an accessing unit which communicates with a first access terminal. The accessing unit communicates the first encoding with the first access terminal. The first access terminal may validate the first encoding with the centralized system. On successful validation, the first access terminal allows the guest to gain entry inside the first premises. As discussed above, the guest may want to change the first premises due to one or more reasons. For, example, the premises may not be suitable for the guest or there may be other issues. Accordingly, the guest may request the attendant associated with the first premises (such as at the reception desk) for changing the premises. Similar to as discussed above, the attendant may take up the request and input the same on a terminal associated with the centralized system which provides information related to second premises based on the request along with a unique code. The features of the unique code are same as discussed above. Alternatively, the attendant may himself/herself choose the room and input the request to generate the unique code only.

The information related to the second premises and the unique code are communicated to the guest. The guest may arrive at the location of the second premises and enter the unique code on a second access terminal associated with the second premises. On validation of the unique code, the second access terminal may prompt the guest to encode the device (already encoded with first encoding) with a second encoding. The second encoding is received by the receiving unit of the accessing device. The second encoding may replace or overwrite the first encoding. Accordingly, the user can access the second premises and other locations based on the second encoding.

The features on the accessing device are executed by a receiving unit, accessing unit, processor, memory, transmitter, and a communication unit along with other units which are described in detail below.

In another embodiment of the invention, the features of the accessing device may be executed by a user terminal. The user terminal may include modules to execute the features of the accessing device by using a user application. It may be noted that the user application may be associated with the centralized server and the access terminals. As an example, the user may install the user application on the user terminal associated with place of stay (for example, a hotel). On entering the hotel, an attendant at the reception desk may ask guest to present a user terminal for encoding with first encoding associated with the access of the first premises. The user may access the first premises by presenting the user terminal on the first access terminal. If the premises (for example, room 101) is not suitable for the guest, the guest may use a user application to send a request to the centralized system for changing the room. Based on the request, the centralized server may directly send information related to the second premises (say, room 102) along with a unique code on the user terminal. The unique code may be input by the guest at the second access terminal associated with the second premises. On successful validation of the unique code, the guest may be prompted to encode the user terminal with second encoding associated with the second premises. Accordingly, the guest may be able to change the room using the user terminal without any communication with the attendant or administrator.

The user terminal may include a first receiving module to receive the first encoding. The user terminal may further include an accessing module to access the first premises. There may be a requesting module to make a request regarding change of the premises. The user terminal communicates with the centralized system to receive the information related to second premises along with a unique code by using the second receiving unit. The unique code may be input by the guest or may be transmitted automatically by the user terminal to the second access terminal at the second premises. On validation of the unique code, the guest may be prompted to encode the user terminal with the second encoding. The second encoding is received by the first receiving unit. Thus, the user terminal may be used to access the second premises using the second encoding. It is to be noted that all the features associated with the modules on the user terminal may be accessed by the user application on the user terminal. The user application may also be associated with the centralized system to securely communicate with the first access terminal, second access terminal and other access systems associated with the centralize system.

For the sake of brevity, the disclosure describes changing the premises from the first premises to the second premises. However, the premises can be changed a number of times one after the other based on the availability of the premises.

FIG. 1 depicts a system (100) for changing the premises using an access system in a convenient way. The system 100 includes a guest (108) with a user terminal (112) and an accessing device 110 provided to the guest for accessing the premises (114). The premises is associated with an access terminal (116). The system further includes a centralized system (106) which can be a server or a cloud. The centralized server is in communication with a terminal (104) used by an attendant or an administrator (102) at a location (for example, a reception). The user terminal (112) is also capable of communicating with the centralized server (106) directly using a user application.

As discussed herein the centralized system includes details related to all the premises. The details may include access details such as access codes, unique codes, encoding details and the like. The centralized system may include the details of the guests staying in the premises along with the details of the premises of stay. The centralized system may be equipped with the details of the privileges and access provided to the guests of each premises separately. The centralized system also processes the request for validation either from the terminal (104) or from the access terminal (116) or from the user terminal of the guest (112). The centralized system is also configured to provide the unique codes and selection of the premises in case a change of the premises is requested. The change of premises may be requested either from the guest with the user terminal (112) or from the terminal (104) of the attendant on behalf of the guest.

The terminal (104) used by the attendant can be a desktop computer or a hand held device such as a user terminal or a smartphone with at least a display, a storage unit and with network connectivity. Example of the terminal or device includes a desktop, workstation PC, a laptop, a smart phone, a tablet, and the like. As an example, the terminal may be an Apple® desktop or smartphone, an Android® desktop or smartphone, a Windows® desktop or smartphone and/or the like. In general, an operating system available on the terminal provides an interface for the user or attendant to interact with the terminal for accessing the centralized system. In an example, the operating system installed on the terminal is a Windows® based operating system, a Mac® based operating system, and a Linux® based operating system or any other operating system known in the art.

Similarly, the user terminal with guest can also be a smartphone with at least a display, a storage unit and with network connectivity. The user terminal may be a laptop, a smart phone, a tablet, and the like. The user terminal is capable of running a user application which can communicate with the centralized system to enable the invention. As an example, the operating system installed on the terminal is a Windows® based operating system, a Mac® based operating system, and a Linux® based operating system or any other operating system known in the art.

Further, the access terminal may be installed along with the premises and may comprise a short-range transceiver, a cellular transceiver, a status detector, a keypad, a processor and a memory. The keypad may have soft buttons (touch based), or hard key buttons known in the art. The access terminal may be a lock, smart lock, a door handle with a lock, an electro-mechanical lock any such device that is understood by a person skilled in the art, Also, the premises can be a room with a door or a floor where the access terminal can be installed.

Figure 2:
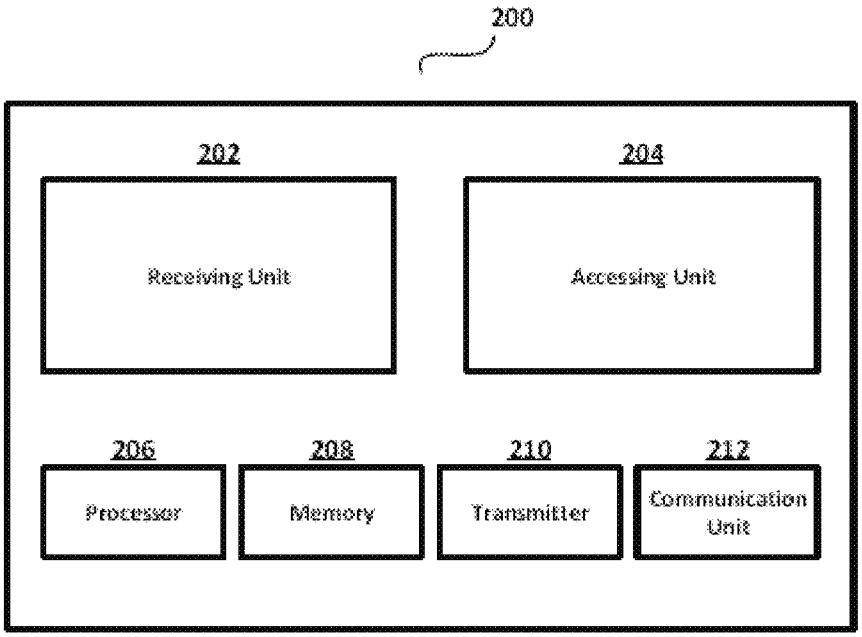
FIG. 2 is an exemplary block diagram of different components of an accessing device according to an exemplary embodiment of the invention.

FIG. 2 depicts an embodiment of the invention with details of an accessing device (200) which is same as the accessing device (112) described in FIG. 1. The accessing device (200) includes a receiving unit (202) for receiving the first encoding from the terminal used by the attendant and second encoding from the second access terminal. The accessing device also includes an accessing unit (204) for accessing the first premises as well as the second premises. The accessing unit (204) communicates with the first access terminal and the second access terminal to enable the access within the first and the second premises, respectively. The accessing device may also include a processor (206), a memory (208), a transmitter (210), and a communication module (212) to achieve various processing and communication tasks. As an example, the communication module can interact with the first access terminal and the second access terminal of the first and second premises, respectively.

Figure 3:
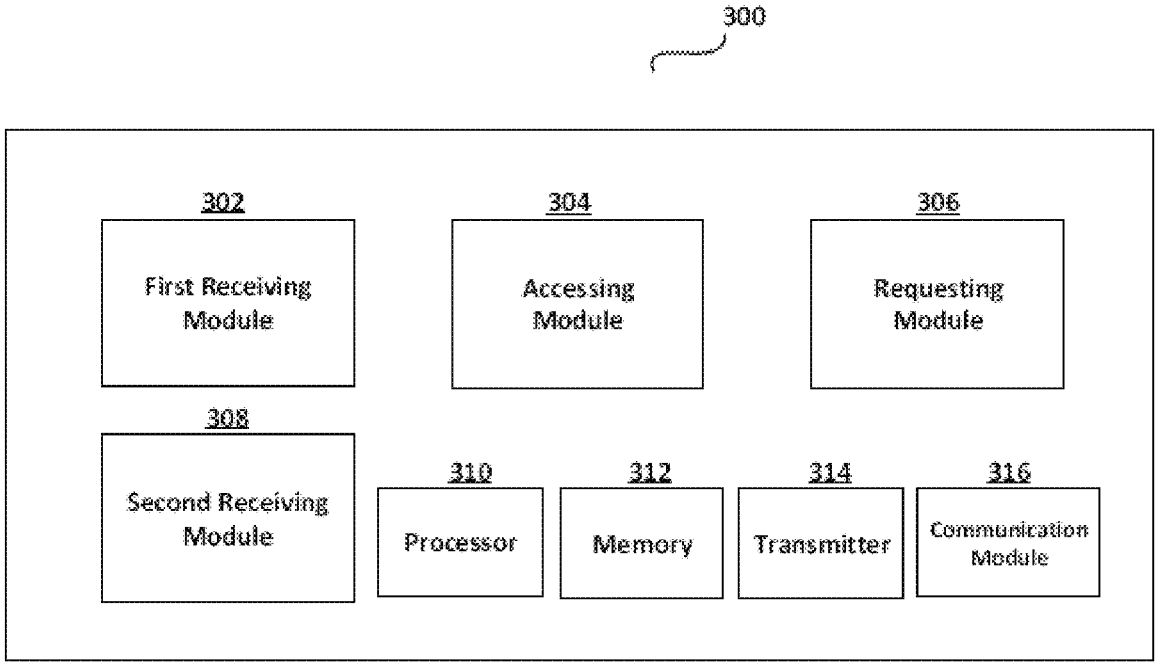
FIG. 3 is an exemplary block diagram of different components of a user terminal according to an exemplary embodiment of the invention.

FIG. 3 depicts the components of a user terminal (300) which can be used by the guest to change the premises. The user terminal may include a first receiving module (302) for receiving a first encoding from a centralized system for permitting entry inside first premises. The user terminal includes an accessing module (304) to access the first premises by communicating with an access terminal associated with the premises. The user terminal includes a requesting module to request change of the premises by communicating with the centralized system. A second receiving module (308) receives a unique code and information related to second premises. The guest may access the second premises with unique code at an access terminal associated with the second premises. The access terminal may further prompt for sending second encoding associated with the second premises. The second encoding is received by the first receiving module (302). The user terminal (300) may also include a processor (310), a memory (312), a transmitter (314), and a communication module (216) to achieve various processing and communication tasks.

Figure 4:
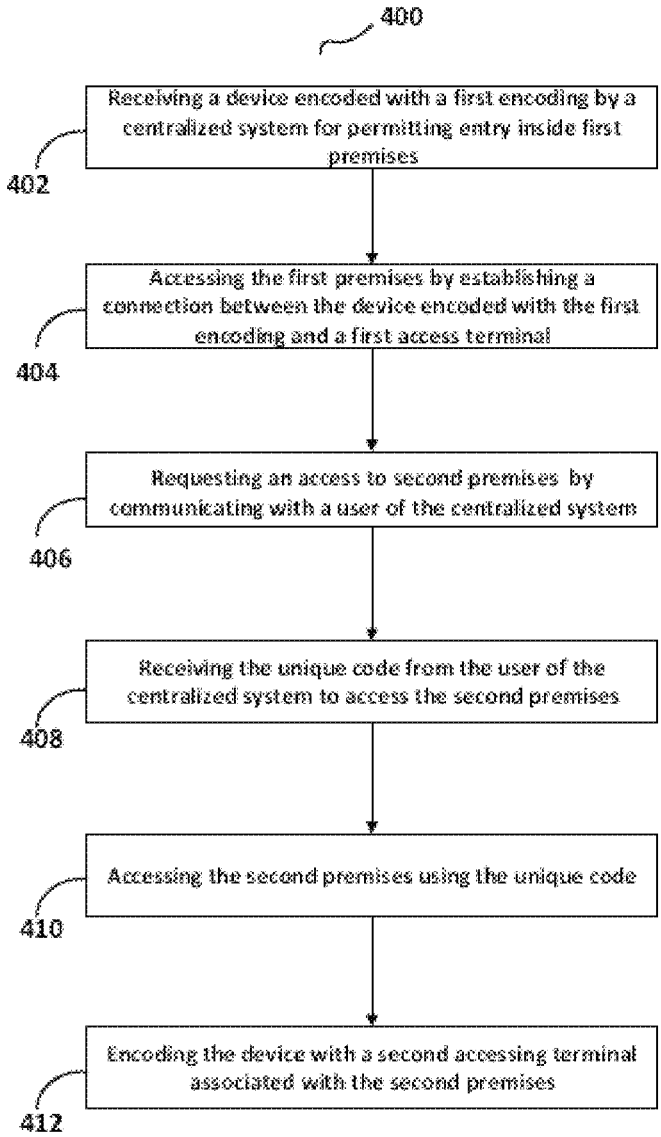
FIG. 4 is an exemplary flowchart illustrating a method to perform the invention according to an exemplary embodiment of the invention.

FIG. 4 depicts a flowchart outlining the features of the invention in an embodiment of the invention. The flowchart 400 describes a method being performed for enabling the invention. The method starts at 402 by receiving a device encoded with a first encoding by a guest to access a first premises. The first encoding is provided by the centralized system. At, 402, the guest can access the first premises using the encoded device with first encoding at a first access terminal. If the user does not like the premises, the guest may request an access to second premises by communicating with a user of the centralized system at 406. Further, at 408, the guest receives the unique code from the user of the centralized system. The user may also receive information related to the second premises such as room number, map of the room, location on map of a building and the like. At 410, the guest accesses the second premises using the unique code. On successful validation of the unique code by the centralized system, a second access terminal associated with the second premises may prompt for encoding the device with a second encoding. The device is encoded with the second encoding by the second access terminal at 412.

In various embodiments of the invention described is a computer readable medium comprising one or more processors and a memory coupled to the processors. The memory stores instructions which are executed by the one or more processors. The processors are configured to receive a first encoding on an accessing device from a centralized system for permitting entry inside first premises. The processor is further configured to access the first premises by connection between the accessing device encoded with the first encoding and a first access terminal associated with the first premises and receive a second encoding from a second access terminal associated with the second premises. The second encoding is received based on a request to change the premises. A user of the centralized server inputs the request to generate a unique code for accessing the second premises from the centralized system. The unique code is received and used to access the second premises. On successful validation of the unique code the second encoding is received.

Exemplary computer readable media includes flash memory drives, digital versatile discs (DVDs), compact discs (CDs), floppy disks, and tape cassettes. By way of example and not limitation, computer readable media comprise computer storage media and communication media. Computer storage media include volatile and nonvolatile, removable and non-removable media implemented in any method or technology for storage of information such as computer readable instructions, data structures, program modules or other data. Computer storage media are tangible and mutually exclusive to communication media. Computer storage media are implemented in hardware and exclude carrier waves and propagated signals. Computer storage media for purposes of this invention are not signals per se. Exemplary computer storage media include hard disks, flash drives, and other solid-state memory. In contrast, communication media typically embody computer readable instructions, data structures, program modules, or other data in a modulated data signal such as a carrier wave or other transport mechanism and include any information delivery media.

Although described in connection with an exemplary computing system environment, examples of the invention are capable of implementation with numerous other general purpose or special purpose computing system environments, configurations, or devices. Examples of the invention may be described in the general context of computer-executable instructions, such as program modules, executed by one or more computers or other devices in software, firmware, hardware, or a combination thereof. The computer-executable instructions may be organized into one or more computer-executable components or modules. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the Figures and described herein. Other examples of the invention may include different computer-executable instructions or components having more or less functionality than illustrated and described herein.

Aspects of the invention transform a general-purpose computer into a special-purpose computing device when configured to execute the instructions described herein.

The order of execution or performance of the operations in examples of the invention illustrated and described herein is not essential, unless otherwise specified. That is, the operations may be performed in any order, unless otherwise specified, and examples of the invention may include additional or fewer operations than those disclosed herein. For example, it is contemplated that executing or performing a particular operation before, contemporaneously with, or after another operation is within the scope of aspects of the invention.

Further reference to any content has been made throughout the specification and words and phrases such as "server", "centralized system", "cloud", or the like have been interchangeably used and means the centralized system for communicating and processing requests from various terminals and devices. Further, the centralized system has all the data for processing and the intelligent logic to enable the invention. Moreover, the words and phrases like "device", "card", "accessing device", or the like have been interchangeably used which means the device which is used to access various premises.

When introducing elements of aspects of the invention or the examples thereof, the articles "a," "an," "the," and "said" are intended to mean that there are one or more of the elements. The terms "comprising," "including," and "having" are intended to be inclusive and mean that there may be additional elements other than the listed elements. The term "exemplary" is intended to mean "an example of" The phrase "one or more of the following: A, B, and C" means "at least one of A and/or at least one of B and/or at least one of C."

Having described aspects of the invention in detail, it will be apparent that modifications and variations are possible without departing from the scope of aspects of the invention as defined in the appended claims. As various changes could be made in the above constructions, products, and methods without departing from the scope of aspects of the invention, it is intended that all matter contained in the above description and shown in the accompanying drawings shall be interpreted as illustrative and not in a limiting sense.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

I claim:

1. A method comprising:

receiving a device encoded with a first encoding by a centralized system for permitting entry inside first premises;

accessing the first premises by establishing a connection between the encoded device with the first encoding and a first access terminal associated with the first premises;

requesting an access to second premises by communicating with a user of the centralized system, wherein the user of the centralized system inputs the request to generate a unique code for the second premises;

receiving the unique code from the user of the centralized system to access the second premises; and accessing the second premises using the unique code, wherein the device is encoded with a second encoding by a second access terminal associated with the second premises on validation of the unique code;

wherein the second accessing terminal prompts for encoding the device after validating the unique code.

2. The method of claim 1, wherein the first encoding and the second encoding comprise configuring details related to accessing the first premises or the second premises.

3. The method of claim 1, wherein the communication of the device with the first accessing terminal comprises validating the encoding by the centralized system.

4. The method of claim 1, wherein the centralized system communicates the unique code to a user terminal.

5. A method comprising:

receiving a device encoded with a first encoding by a centralized system for permitting entry inside first premises;

accessing the first premises by establishing a connection between the encoded device with the first encoding and a first access terminal associated with the first premises;

requesting an access to second premises by communicating with a user of the centralized system, wherein the user of the centralized system inputs the request to generate a unique code for the second premises;

receiving the unique code from the user of the centralized system to access the second premises; and accessing the second premises using the unique code, wherein the device is encoded with a second encoding by a second access terminal associated with the second premises on validation of the unique code;

wherein accessing the second premises with the unique code and encoding the device with the second encoding by the second accessing device is done by a master user associated with the centralized system.

6. The method of claim 1, wherein the unique code is a numeric key generated by the centralized system.

7. The method of claim 1, wherein the unique code is a predefined pattern generated by the centralized system.

8. The method of claim 1, wherein the unique code is configured to be used only once.

9. An accessing device comprising:

a receiving unit configured to receive a first encoding from a centralized system for permitting entry inside first premises;

an accessing unit configured to access the first premises by communicating the first encoding with a first access terminal associated with the first premises; and the receiving unit further configured to receive a second encoding from a second access terminal associated with a second premises, wherein the second encoding is received based on a request to change the premises, wherein a user of the centralized server inputs the request to generate a unique code for accessing the second premises, wherein the unique code is received and used to access the second premises and subsequently a second encoding is received after validation of the unique code.

10. The accessing device of claim 9, wherein the first encoding and the second encoding comprise configuring details related to accessing the first premises and the second premises, respectively.

11. The accessing device of claim 9, wherein the second accessing device prompts for encoding the device after validating the unique code.

12. The accessing device of claim 9, wherein the second encoding is received from the centralized system by the second access terminal and transmitted to the receiving unit of the accessing device.

13. The accessing device of claim 9, wherein accessing the second premises with the unique code and encoding the accessing device with the second access terminal is done by a master user associated with the centralized system.

14. The accessing device of claim 9, wherein the unique code is a numeric key generated by the centralized system.

15. The accessing device of claim 9, wherein the unique code is a predefined pattern generated by the centralized system.

16. The accessing device of claim 9, wherein the unique code is configured to be used only once.

17. A non-transitory computer readable medium comprising memory storing instructions which are executed by the one or more processors, the one or more processors configured to:

receive a first encoding on an accessing device from a centralized system for permitting entry inside first premises;

access the first premises by connection between the accessing device encoded with the first encoding and a first access terminal associated with the first premises; and receive a second encoding from a second access terminal associated with the second premises on the accessing device;

wherein the second encoding is received based on a request to change the premises, wherein a user of the centralized server inputs the request to generate a unique code for accessing the second premises, wherein the unique code is received and used to access the second premises, wherein the second encoding is received after validation of the unique code;

wherein the second accessing terminal prompts for encoding the device after validating the unique code.

18. The non-transitory computer readable medium of claim 17, wherein the encoding comprises configuring details related to accessing the first premises or the second premises.

19. The non-transitory computer readable medium of claim 17, wherein the unique code is a predefined pattern generated by the centralized system.

* * * * *